United States Patent [19]

Sorrell

[11] Patent Number: 4,726,554

[45] Date of Patent: Feb. 23, 1988

[54] SYSTEM FOR MOUNTING HOOKS ON DISPLAY BOARDS AND COMPONENTS OF SUCH SYSTEM

[76] Inventor: Steven J. Sorrell, 4 Stoneham Dr., Livingston, N.J. 07039

[21] Appl. No.: 855,000

[22] Filed: Apr. 22, 1986

[51] Int. Cl.[4] ..... A47F 5/08

[52] U.S. Cl. ..... 248/222.2; 248/225.2; 211/59.1; 211/87

[58] Field of Search ..... 248/73, 307, 220.2, 248/222.2, 222.3, 223.4, 224.1, 224.2, 224.4, 225.1, 225.2; 211/57.1, 59.1, 94, 87

[56] References Cited

U.S. PATENT DOCUMENTS

| | | | |
|---|---|---|---|
| 1,188,227 | 6/1916 | Woods | 211/87 |
| 1,504,523 | 8/1924 | Sherer | 248/222.2 |
| 1,739,057 | 12/1929 | Bock | 248/307 |
| 1,807,356 | 5/1931 | Vance . | |
| 3,235,218 | 2/1966 | Graham | 248/220.3 |
| 3,297,290 | 1/1967 | Patterson | 248/223 |
| 3,669,035 | 6/1972 | Grossman | 248/225.2 |
| 4,189,123 | 2/1980 | Johnson | 248/222.2 |
| 4,211,379 | 7/1980 | Morgan | 248/222.2 |
| 4,308,961 | 1/1982 | Kunce | 211/94.5 |
| 4,340,144 | 7/1982 | Cousins | 248/222.2 |
| 4,461,443 | 7/1984 | Dauman | 248/220.3 |
| 4,579,308 | 4/1986 | Jensen | 248/225.1 |
| 4,591,058 | 5/1986 | Amstutz | 248/222.2 |
| 4,607,753 | 8/1986 | Radek | 211/94 |

FOREIGN PATENT DOCUMENTS

| | | | |
|---|---|---|---|
| 2450582 | 11/1980 | France | 211/94 |
| 1153392 | 5/1969 | United Kingdom | 248/225.2 |

*Primary Examiner*—J. Franklin Foss
*Assistant Examiner*—Robert A. Olson
*Attorney, Agent, or Firm*—Charles E. Baxley

[57] ABSTRACT

A system for mounting hooks on a board comprises a special board member and a special hook member. The board member has at least one horizontal channel of special configuration such that the special hook member can be placed in interengagement with the channel at any desired horizontal location but the hook member is not subject to dislodgement from the channel by upwardly directed force accidentally applied to the hook member.

12 Claims, 10 Drawing Figures

SYSTEM FOR MOUNTING HOOKS ON DISPLAY BOARDS AND COMPONENTS OF SUCH SYSTEM

BACKGROUND OF THE INVENTION

This invention relates to a system for mounting hooks on display boards and the like and to components of such system.

The prior art teaches vertically positionable boards having horizontal grooves or channels interengageable with hooks that are insertable in the grooves only from the ends of the grooves. This is often inconvenient.

The prior art also teaches systems with vertically positionable boards with horizontal channels for interengagement with hooks at any desired longitudinal channel location. Such systems are subject to the disadvantage that the hooks are often undesirably dislodged from the board by accidental but unavoidable upward force applied to the hooks, which of necessity protrude a substantial horizontal distance from the board.

Dauman U.S. Pat. No. 4,461,443, issued July 24, 1984, discloses a typical prior art hook 20 that is subject to such accidental dislodgement. The Dauman patent also discloses a modified hook 21 that is equally subject to such dislodgement.

Kunce U.S. Pat. No. 4,308,961, issued Jan. 5, 1982, discloses a special horizontal rail having a base and different upper and lower flanges overlapping the base. A special hook member is provided with a base member, a collar welded to the base member and a rod one end of which is anchored to the collar. The base member is interengageable with the rail at any horizontal location with the rod protruding from the base member, but upward force accidentally applied to the rod may dislodge the hook member from the rail. Furthermore, the rail is subject to inadvertent inverted installation.

Other prior art U.S. patents which may be of interest herein are the following:

- U.S. Pat. No. 1,188,227, issued June 20, 1916 to Woods et al.;
- U.S. Pat. No. 1,807,356, issued May 26, 1931 to Vance;
- U.S. Pat. No. 3,235,218, issued Feb. 15, 1966 to Graham; and
- U.S. Pat. No. 3,297,961, issued Jan. 10, 1967 to Patterson.

To summarize the prior art, display board systems are known having boards with channels and hooks interengageable with the channels but which must be placed in such interengagement only inconveniently by insertion into the channels from the ends thereof. Systems are also known having boards with channels and hooks which can be placed in interengagement with the channels at any desired horizontal channel location but in such systems the hooks are subject to dislodgement by accidental upward force applied to the hooks.

The present invention has the advantage of providing a system having a board member with horizontal channels of special configuration and hooks of special configuration, such that the hooks can be placed in interengagement with the channels at any desired horizontal location but the hooks are not subject to dislodgement from the channels by upwardly directed force accidentally applied to the hooks.

Important objects of the invention are to provide a system and components thereof having the advantages mentioned in the preceding paragraph.

Another important object is to provide such a system that is of simple, inexpensive construction.

Further objects and advantages will appear hereinafter.

SUMMARY OF THE INVENTION

The inventive system for mounting hooks on a board comprises a board member and a hook member.

The board member includes a front surface and a horizontal channel provided in part by the front surface and having upper and lower ribs projecting from the front surface. The ribs provides a ceiling and a floor, the floor being wider than the ceiling. An upper flange has an upper inner surface projecting downwardly from the edge of the ceiling remote from the front surface and confronts the front surface and a downwardly facing bottom surface extending outwardly from the upper inner surface. A lower flange has a lower inner surface projecting upwardly from the edge of the floor remote from the front surface and confronts the front surface. A lower outer surface faces away from the lower inner surface, and an upwardly facing top surface joins the lower inner surface and the lower outer surface. The downwardly facing bottom surface and the upwardly facing top surface provide an opening therebetween.

The hook member includes a body portion and a hook portion projecting therefrom. The body portion includes a bottom surface, a top surface, a rear surface, a guiding and retaining projection extending rearwardly from the rear surface and upwardly from the top surface, a downwardly facing surface extending forwardly from the bottom edge of the rear surface and spaced above the bottom surface, a forwardly facing surface extending upwardly from the forward edge of the downwardly facing surface and a rearwardly facing surface extending upwardly from the rearward edge of the bottom surface and confronting the forwardly facing surface and forming therewith a slot extending across the body portion.

The projection is insertable through the opening and into the space between the upper flange and the front surface to a position in which the downwardly facing surface clears the upwardly facing top surface of the lower flange. The body portion is then rotatable to bring the projection into confronting engagement with the front surface, the rear surface of the hook portion into confronting engagement with the lower outer flange surface and the slot into alignment with the lower flange. The body portion is then movable downwardly to cause the slot to straddle and snugly receive the lower flange with the downwardly facing surface bottomed on the floor and the forwardly facing surface in overlapping engagement with the lower inner surface of the lower flange.

The hook member cannot be dislodged from the board member by upward force accidentally applied to the hook member.

DESCRIPTION OF THE INVENTION

Figure 1:
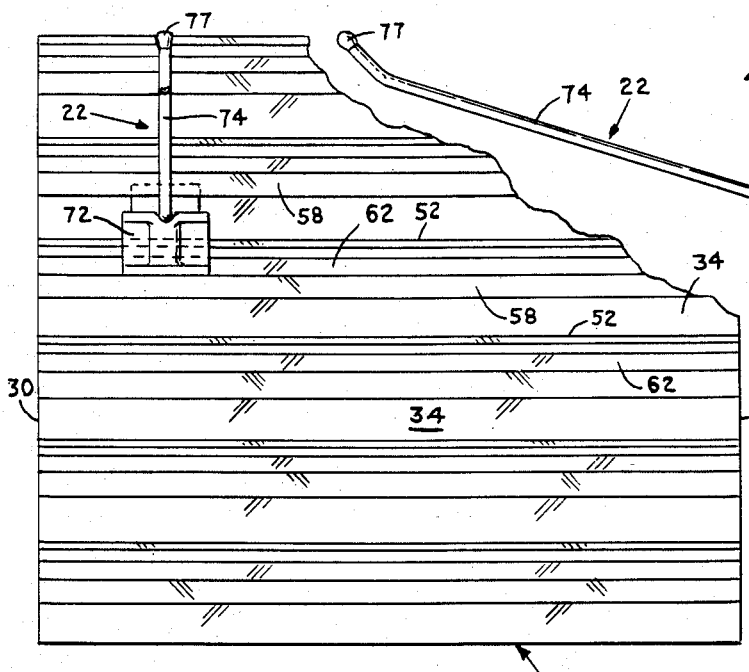
FIG. 1 is a front elevation of an assembly of a mounting board member embodying the invention and a single hook member embodying the invention, the board member being shown fragmentarily.

The drawing shows a system for mounting hooks on display boards and the like. The system comprises two components, namely a board member 20 shown in FIGS. 1, 2 and 8 through 10 and a hook member 22 shown in all the views, it being understood that a great number of hook members 22 could be employed with a single board member 20.

Board member 20 is of one-piece construction of substantially constant wall thickness and can be fabricated of any suitable material, a satisfactory example of which is high impact polystyrene, which is capable of a certain amount of flexure in relatively thin sections.

Board member 20 will be further described as though mounted on other structure (not shown) with the viewer facing board member 20.

Board member 20 has a rectangular body portion 24 having top and bottom edge surfaces 26 and 28, respectively, left and right edge surfaces 30 and 32, respectively and front and rear parallel face surfaces 34 and 36, respectively. Protruding rearwardly from top edge surface 26 and overlapping rear surface 36 is a top mounting flange 38 providing a downwardly facing top channel 40 and protruding rearwardly from bottom edge surface 28 and overlapping rear surface 36 is a bottom mounting flange 42 providing an upwardly facing bottom channel 44 confronting and a mirror image of channel 40. Channels 40 and 44 provide means whereby board member 20 can be mounted on the other structure.

Board member 20 also has, protruding from face surface 34, a plurality of identical horizontal channels 46 of special configuration to be described, it being noted that surface 34 provides the bottom of each channel 46. The illustrated board member 20 has five channels 46, but this number could be more or less, as desired, and could be as low as one. Furthermore, each channel 46 is of the same configuration at any longitudinal location.

Only one channel 46 needs to be described. The one chosen is the lower channel 46 shown in FIG. 8, where it is seen that each channel 46 has an upper rib 48, a lower rib 50 and an intermediate rib 52, each projecting forwardly (to the left as shown) from surface 34 and perpendicular thereto. Upper rib 48 provides channel 46 with a ceiling 54 and lower rib 50 provides channel 46 with a floor 56. Floor 56 has a greater dimension perpendicular to surface 34 than does ceiling 54, by approximately the thickness of the material of panel member 20. Extending downwardly from the edge of ceiling 54 remote from surface 34 is an upper longitudinal flange 58 having an upper inner wall surface 60 parallel to and confronting surface 34. Extending upwardly from the edge of floor 56 remote from surface 34 is a longitudinal flange 62 having a lower inner wall surface 64 parallel to and confronting surface 34. The lower extremity of flange 58 is determined by a downwardly facing bottom surface 66 perpendicular to surface 34 and extending outwardly from the lower edge of surface 60, while the upper extremity of flange 62 is determined by an upwardly facing top surface 68 perpendicular to surface 34 and extending outwardly from the upper edge of surface 64.

Flange 58 also has an upper outer wall surface 70 intersecting and perpendicular to surface 66 at its outer edge. Surface 70 is substantially coplanar with wall surface 64 of flange 62. Flange 62 also has a lower outer wall surface 71 intersecting and perpendicular to surface 68 at its outer edge.

If desired, surfaces 70 and 71 could be tapered such that flanges 58 and 62 are thinnest at the lines of intersection of surfaces 70 and 71 with surfaces 66 and 68, respectively.

Intermediate rib 52 is closer to floor 56 than it is to ceiling 54 and does not extend very far from surface 34. Rib 52, if used, principally serves a stiffening function.

The plane of downwardly surface 66 is above the plane of upwardly facing surface 68, whereby surfaces 66 and 68 provide channel 46 with an opening for reception of a portion of hook member 22.

It should be appreciated that upper rib 48 of one channel 46 also provides lower rib 50 of any next higher channel 46, and lower rib 50 of one channel 46 also provides upper rib 48 of any next lower channel 46.

Figure 2:
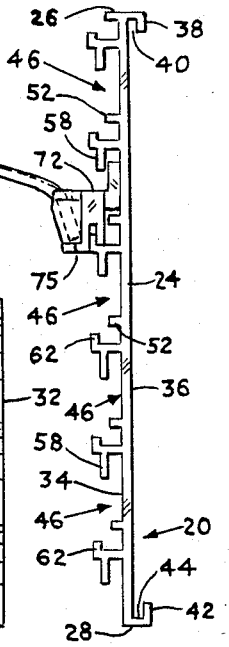
FIG. 2 is a view of the righthand end of the assembly of FIG. 1.
Figure 3:
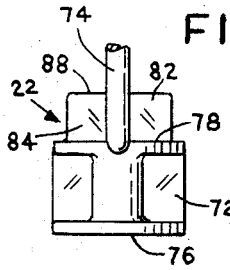
FIG. 3 is a fragmentary front view of the hook member of FIG. 1.
Figure 4:
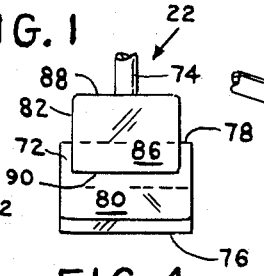
FIG. 4 is a fragmentary rear view of the hook member of FIG. 1.
Figure 5:
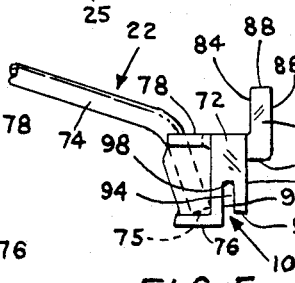
FIG. 5 is a fragmentary righthand end view of the hook member of FIG. 1.
Figure 6:
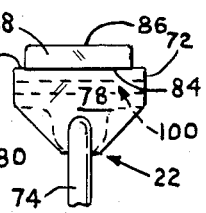
FIG. 6 is a fragmentary top view of the hook member of FIG. 1.
Figure 7:
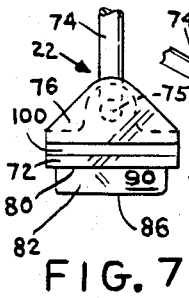
FIG. 7 is a fragmentary bottom view of the hook member of FIG. 1.

Hook member 22 comprises a body portion 72 of suitable plastic material, and an elongated metal hook portion 74, one end of which is shown at 75 in FIGS. 2 and 5 embedded in body portion 72. Hook member 22 is readily formed by molding body portion 72 in one piece about that one end of hook portion 74. At its other end, hook portion 74 terminates in a knob 77 as shown in FIGS. 1 and 2.

Hook portion 74 is angled diagonally upwardly from body portion 72 and defines a plane which bisects body portion 72 which is symmetrical with respect to that plane, as can be seen in FIGS. 1, 3, 4, 6 and 7.

Body portion 72 is substantially rigid and is of special configuration whereby it can be brought into engagement with any channel 46 at any longitudinal location thereof, without being subject to dislodgement from channel 46 by upwardly directed force applied accidentally to hook portion 74.

Body portion 72 has a bottom surface 76, a top surface 78 parallel to bottom surface 76 and a rear surface 80 perpendicular to and intersecting top surface 78. Extending rearwardly from rear surface 80 and upwardly from the plane of top surface 78 is a solid guiding and retaining projection 82 having a forward surface 84, a back surface 86, an upper surface 88 and a lower surface 90.

Forward surface 84 is parallel to and spaced slightly rearwardly from the plane of rear surface 80. Back surface 86 is parallel to forward surface 84, lower surface 90 is perpendicular to rear surface 80 and upper surface 88 is parallel to lower surface 90.

Forwardly extending from the bottom edge of rear surface 80 is a downwardly facing surface 92 which is parallel to bottom surface 76 and spaced above the plane thereof.

Upwardly extending from the forward edge of surface 92 is a forwardly facing plane surface 94 parallel to rear surface 80 and upwardly extending from the rearward edge of bottom surface 76 is a rearwardly facing surface 96 parallel to and confronting surface 94. The upper edges of surfaces 94 and 96 are joined by a downwardly facing surface 98 which is perpendicular to surfaces 94 and 96. Surfaces 94, 96 and 98 provide body portion 72 with a downwardly facing locking slot 100 extending across body portion 72.

Channel 46 of board member 20 and body portion 72 of hook member 22 have certain dimensional relationships. Among those dimensional relationships are the following:

(a) The distance between surfaces 84 and 86, i.e., the thickness of locking projection 82, is slightly less than the distance between surfaces 34 and 60, so that projection 82 can be freely received between surfaces 34 and 60;

(b) The distance from the plane of surface 86 to the plane of surface 96 is substantially the same as the distance from surface 34 to surface 64;

(c) The thickness of flange 62 is substantially the same as the width of locking slot 100, so that flange 62 can be snugly received in slot 100;

(d) The distance from flange 52 to ceiling 54 is greater than the distance from surface 88 to surface 90, i.e., the height of projection 82;

(e) The distance between the planes of surfaces 76 and 88 is greater than the vertical distance between surface 68 and ceiling 54;

(f) The distance between the planes of surfaces 92 and 88 is less than the vertical distance between surface 68 and ceiling 54;

(g) The height of surface 68 above floor 56 is not greater than, and as shown is less than, the depth of locking slot 100 as measured between the planes of surfaces 92 and 98; and (h) The distance with intermediate rib 52 projects forwardly from surface 34 is less than the difference between the distance between surfaces 34 and 64 and the distance between surfaces 80 and 94.

The manner of achieving interengagement of body portion 72 of hook member 22 and any one of channels 46 of board member 20 at any desired longitudinal location of that channel 46 will now be described, with particular reference to FIGS. 8, 9 and 10.

Figure 8:
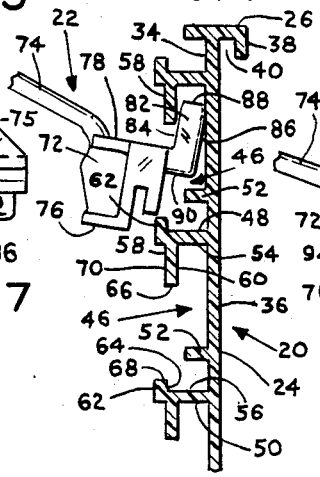
FIGS. 8, 9 and 10 are enlarged fragmentary views similar to FIG. 2, depicting the manner in which the hook member is assembled with the board member, showing an initial step in the assembly, an intermediate step in the assembly and the final relationship of the parts, respectively.
Figure 9:
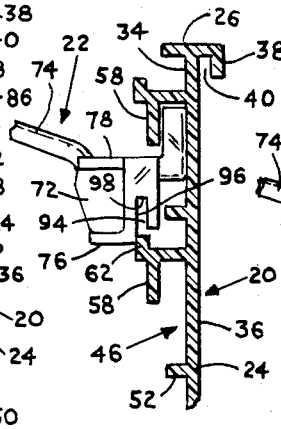

First, as shown in FIG. 8, with projection 82 facing upwardly and with hook portion 74 angled more sharply upwardly than it will be when in its final position, projection 82 is inserted between board member surface 34 and surface 60 of flange 58 and slight upward pressure is applied to body portion 72 until the line which is the intersection of body portion surfaces 80 and 92 clears the outer edge of surface 68. The parts are now relatively oriented as shown in FIG. 8.

Next, hook member 22 is rotated slightly counterclockwise to an intermediate position in which surface 96 of hook member body portion 72 comes into engagement with outer surface 71 of flange 62 and surface 86 of projection 82 comes into engagement with surface 34. In this intermediate position shown in FIG. 9, surface 92 is above surface 68 of flange 62 and locking slot 100 is aligned with flange 62.

Figure 10:
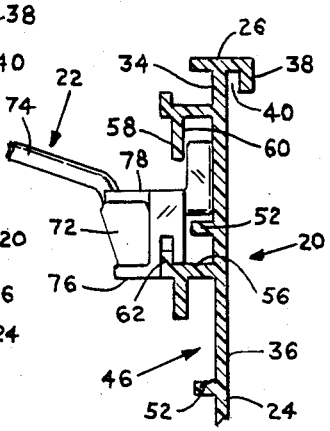

Finally, hook member 22 is moved straight downward until, as shown in FIG. 10, surface 92 bottoms on floor 56 and locking slot 100 straddles and snugly receives flange 62, thus completing the installation of hook member 22 and board member 20.

Thereafter, upward force accidentally applied to hook portion 74 will not dislodge hook member 22 from board member 20, for such upward force will tend to rotate body portion 72 in a clockwise direction and such rotation is prevented by the engagement of surface 94 of body portion 72 and surface 64 of flange 62.

If desired, hook member 22 can be removed from board member 20 by simply reversing the installation procedure.

Locking projection 82 need not be solid as illustrated and described. Instead, it could be provided by a pair of spaced posts, for example, which could be cylindrical.

Hook member 22 can alternatively be brought into interengagement with any channel 46 of board member 20 by sliding body portion 72 into channel 46 from an end thereof.

It is apparent that the invention well attains the stated objects and advantages and others.

The disclosed details are exemplary only and are not to be taken as limitations on the invention except as those details may be included in the appended claims.

What is claimed is:

1. A system for mounting hooks on a board, said system comprising a board member and a hook member, said board member including a front surface and a horizontal channel provided in part by said front surface and having upper and lower ribs projecting from said front surface and providing a ceiling and a floor, respectively, said floor being wider than said ceiling, an upper flange having an upper inner surface projecting downwardly from the edge of said ceiling remote from said front surface and confronting said front surface and a downwardly facing bottom surface extending outwardly from said upper inner surface, and a lower flange having a lower inner surface projecting upwardly from the edge of said floor remove from said front surface and confronting said front surface, a lower outer surface facing away from said lower inner surface, and an upwardly facing top surface joining said lower inner surface and said lower outer surface, said downwardly facing bottom surface and said upwardly facing top surface providing an opening therebetween, said hook member including a body portion and a hook portion projecting therefrom, said body portion including a bottom surface, a top surface, a rear surface, a guiding and retaining projection extending rearwardly from said rear surface and upwardly with respect to said top surface, a downwardly facing surface extending forwardly from the bottom edge of said rear surface and spaced above said bottom surface, a forwardly facing surface extending upwardly from the forward edge of said downwardly facing surface and a rearwarly facing surface extending upwardly from the rearward edge of said bottom surface and confronting said forwardly facing surface and forming therewith a slot extending across said body portion, said projection being insertable through said opening and into the space between said upper flange and said front surface to a position in which said downwardly facing surface clears said upwardly facing top surface of said lower flange and said body portion is then rotatable to bring said projection into confronting engagement with said front surface and into overlapping relationship with said upper flange and said rear surface of said body portion into confronting engagement with said lower outer flange surface and said slot into alignment with said lower flange, and said body portion is then movable downwardly to cause said slot to straddle and snugly receive said lower flange with said downwardly facing surface bottomed on said floor and said forwarly facing surface in overlapping engagement with said lower inner surface of said lower flange and with said projection still in overlapping relationship with said upper flange.

2. A system according to claim 1 wherein said board member is of one-piece construction and is of substantially constant wall thickness 3. A system according to claim 1 wherein said channel is of the same size and shape at all longitudinal locations.

4. A system according to claim 1 wherein the thickness of said guiding and retaining projection is less than the distance between said front surface and said upper inner surface of said upper flange, so that said projection is freely receivable therebetween.

5. A system according to claim 1 wherein said guiding and retaining projection has a back surface which is spaced from the plane of said rearwardly facing surface a distance which is substantially the same as the distance between said front surface and said lower outer surface.

6. A system according to claim 1 wherein the thickness of said lower flange is substantially the same as the width of said slot.

7. A system according to claim 1 wherein the vertical distance from said bottom surface of said body portion to the top of said guiding and retaining projection is greater than the distance from the plane of said upwardly facing top surface of said lower flange to said ceiling.

8. A system according to claim 1 wherein the distance between said downwardly facing surface which extends forwardly of said rear surface of said body portion and the top of said guiding and retaining projection is less than the vertical distance between said upwardly facing top surface of said lower flange and said ceiling.

9. A system according to claim 1 wherein the height of said upwardly facing top surface of said lower flange above said floor is not greater than the depth of said slot.

10. A system for mounting hooks on a board, said system comprising a board member and a hook member, said board member including a front surface and a horizontal channel of the same size and shape at all longitudinal locations provided in part by said front surface and having upper and lower ribs projecting from said front surface and providing a ceiling and a floor, respectively, said floor being wider than said ceiling, an upper flange having an upper inner surface projecting downwardly from the edge of said ceiling remote from said front surface and confronting said front surface and a downwardly facing bottom surface extending outwardly from said upper inner surface, and a lower flange having a lower inner surface projecting upwardly from the edge of said floor remote from said front surface and confronting said front surface, a lower outer surface facing away from said lower inner surface, and an upwardly facing top surface joining said lower inner surface and said lower outer surface, said downwardly facing bottom surface and said upwardly facing top surface providing an opening therebetween, said hook member including a body portion and a hook portion projecting therefrom, said body portion including a bottom surface, a top surface, a rear surface, a guiding and retaining projection extending rearwardly from said rear surface and upwardly from said top surface, a downwardly facing surface extending forwardly from the bottom edge of said rear surface and spaced above said bottom surface, a forwardly facing surface extending upwardly from the forward edge of said downwardly facing surface and a rearwardly facing surface extending upwardly from the rearward edge of said bottom surface and confronting said forwardly facing surface and forming therewith a slot extending across said body portion, said projection being insertable through said opening and into the space between said upper flange and said front surface to a position in which said downwardly facing surface clears said upwardly facing top surface of said lower flange and said body portion is then rotatable to bring said projection into confronting engagement with said front surface and said rear surface of said hook portion into confronting engagement with said lower outer flange surface and said slot into alignment with said lower flange, and said body portion is then movable downwardly to cause said slot to straddle and snugly receive said lower flange with said downwardly facing surface bottomed on said floor and said forwardly facing surface in overlapping engagement with said lower inner surface of said lower flange, wherein said channel is a first channel and said board member further includes a second channel immediately below said first channel and of the same size and shape as said first channel and said lower rib of said first channel provides said upper rib of said second channel.

11. A component of a system for mounting hooks on a board, said component comprising a board member including a front surface and a horizontal channel provided in part by said front surface and having upper and lower ribs projecting from said front surface and providing a ceiling and a floor, respectively, said floor being wider than said ceiling, an upper flange having an upper inner surface projecting downwardly from the edge of said ceiling remote from said front surface and confronting said front surface and a downwardly facing bottom surface extending outwardly from said upper inner surface, and a lower flange having a lower inner surface projecting upwardly from the edge of said floor remote from said front surface and confronting said front surface, a lower outer surface facing away from said lower inner surface, and an upwardly facing top surface joining said lower inner surface and said lower outer surface, said downwardly facing bottom surface and said upwardly facing top surface providing an opening therebetween, a portion of a hook member being insertable in said opening into interengagement with said channel.

12. A component of a system for mounting hooks on a board, said component comprising a hook member including a body portion and a hook portion projecting therefrom, said body portion including a bottom surface, a top surface, a rear surface and a guiding and retaining projection extending rearwardly from said rear surface and upwardly with respect to said top surface, a downwardly facing surface extending forwardly from the bottom edge of said rear surface and spaced above said bottom surface, a forwardly facing surface extending upwardly from the lower edge of said downwardly facing surface and a rearwardly facing surface extending upwardly from the rearward edge of said bottom surface and confronting said forwardly facing surface and forming therewith a slot extending across said body portion, said hook member body portion being insertable into an opening in a board member into interengagement with a channel in the board member.

* * * * *